US007419142B2

(12) United States Patent
Counts

(10) Patent No.: US 7,419,142 B2
(45) Date of Patent: Sep. 2, 2008

(54) VARIABLE FUEL ADMISSION CARBURETOR

(76) Inventor: Paul H. Counts, 215 N. Lamar St., Haysville, KS (US) 67060-1266

( * ) Notice: Subject to any disclaimer, the term of this patent is extended or adjusted under 35 U.S.C. 154(b) by 0 days.

(21) Appl. No.: 11/607,327

(22) Filed: Dec. 2, 2006

(65) Prior Publication Data

US 2008/0054499 A1 Mar. 6, 2008

Related U.S. Application Data

(60) Provisional application No. 60/842,392, filed on Sep. 5, 2006.

(51) Int. Cl.
*F02M 7/14* (2006.01)

(52) U.S. Cl. ..... 261/62; 251/120; 251/279; 261/118; 261/DIG. 39

(58) Field of Classification Search ..... 261/62, 261/115–118, 41.1, 41.4, DIG. 39; 251/120, 251/279
See application file for complete search history.

(56) References Cited

U.S. PATENT DOCUMENTS

| | | | | | |
|---|---|---|---|---|---|
| 1,080,118 | A | * | 12/1913 | Monosmith | 261/41.4 |
| 1,096,750 | A | * | 5/1914 | Pond | 261/62 |
| 1,246,355 | A | * | 11/1917 | Thomas | 261/22 |
| 1,339,095 | A | * | 5/1920 | Bradshaw | 261/66 |
| 1,630,723 | A | * | 5/1927 | Swan | 261/62 |
| 1,788,914 | A | * | 1/1931 | Hamlin | 261/46 |
| 3,207,492 | A | * | 9/1965 | Zikesch | 261/46 |
| 3,214,150 | A | * | 10/1965 | Rice | 261/62 |
| 3,222,136 | A | * | 12/1965 | Hess et al. | 422/151 |
| 3,226,099 | A | * | 12/1965 | Black et al. | 261/35 |
| 3,336,013 | A | * | 8/1967 | Salo | 261/39.1 |
| 3,680,846 | A | * | 8/1972 | Bickhaus et al. | 261/51 |
| 3,682,449 | A | * | 8/1972 | Severn | 261/23.2 |
| 3,747,906 | A | * | 7/1973 | Arnold et al. | 261/118 |
| 3,767,174 | A | * | 10/1973 | Heeney | 261/62 |
| 4,054,621 | A | * | 10/1977 | Bubniak et al. | 261/46 |
| 4,130,611 | A | * | 12/1978 | Brand | 261/66 |
| 4,260,563 | A | * | 4/1981 | Brulhet | 261/23.1 |
| 4,266,571 | A | * | 5/1981 | Bauder | 137/625.48 |
| 4,272,460 | A | * | 6/1981 | Watanabe et al. | 261/53 |
| 4,351,305 | A | * | 9/1982 | Isogai et al. | 123/590 |
| 4,358,414 | A | * | 11/1982 | Webster et al. | 261/53 |
| 4,559,185 | A | * | 12/1985 | Seto et al. | 261/41.5 |
| 4,751,942 | A | * | 6/1988 | Dyer et al. | 137/599.08 |
| 4,783,286 | A | * | 11/1988 | Lee | 261/23.2 |
| 5,562,869 | A | * | 10/1996 | Drahos et al. | 261/71 |
| 5,694,904 | A | * | 12/1997 | Osanai | 123/520 |
| 6,755,622 | B1 | * | 6/2004 | Hartnagel et al. | 417/42 |
| 6,782,692 | B2 | * | 8/2004 | Hodinot et al. | 60/39.281 |
| 6,802,300 | B2 | * | 10/2004 | Dutt | 123/506 |
| 7,270,313 | B1 | * | 9/2007 | Counts | 261/62 |
| 2002/0060374 | A1 | * | 5/2002 | Berriman et al. | 261/78.1 |
| 2004/0070090 | A1 | * | 4/2004 | Palm | 261/62 |

FOREIGN PATENT DOCUMENTS

| | | | | | |
|---|---|---|---|---|---|
| JP | 6-147015 | A | * | 5/1994 | 261/62 |

* cited by examiner

*Primary Examiner*—Richard L Chiesa
(74) *Attorney, Agent, or Firm*—Ruth Eure

(57) ABSTRACT

A variable fuel admission carburetor is provided including a piston and cylinder that are mated concentrically, and coexist in a carburetor chamber. The cylinder includes a longitudinal slot which allows varying amount of fuel into the carburetor. Through the relative longitudinal movement of the piston in the cylinder, the exposed length of the slot is varied, thereby varying the amount and rate that the fuel enters the chamber.

16 Claims, 5 Drawing Sheets

VARIABLE FUEL ADMISSION CARBURETOR

CLAIM OF PRIORITY

This patent application claims priority from U.S. Provisional Patent Application Ser. No. 60/842,392 filed Sep. 5, 2006.

FIELD OF THE INVENTION

This invention relates to the field of internal combustion engines, and more specifically to fuel delivery systems for internal combustion engines.

BACKGROUND OF THE INVENTION

This invention relates to a carburetor and in particular mechanisms that control and vary the fuel supply to the carburetor. Traditional carburetor systems essentially draw fuel into the carburetor using the pressure differential created by the varying airflow through the system. This airflow is varied using a valve placed in the air stream. The faster the air, the more fuel is drawn into the system.

Some existing inventions include that described in U.S. Pat. No. 4,266,571, to Bauder, for example. This reference describes a rotary valve piston movable in a valve cylinder and having a spiral groove for delivery of the fuel through a plurality of triangular ports. It appears that the cylinder of this reference includes one port being a feed port, one port being a discharge port and a return channel. The invention of the present invention, by contrast, comprises only one slot and grooved cylinder.

U.S. Pat. No. 6,782,692, to Hodinot, describes another fuel metering device for use in turbocharged machines, such as aircraft. The device of this patent includes a plurality of holes in an outer cylinder and a plurality of ports.

U.S. Pat. No. 6,802,300 to Dutt describes a stroke controlled valve as a fuel metering device. This device has a valve needle which may be actuated against the resistance of a spring. This device also has a high pressure area which is connected to an injection nozzle.

Another approach is described in U.S. Pat. No. 6,755,622 to Hartnagel. This device describes a piston actuated by a solenoid coil and spring-loaded valves.

None of the above cited references put forth as simple and straightforward a method of varying fuel supply to a carburetor as the present invention.

SUMMARY OF THE INVENTION

The present invention consists of a simple and efficient method to control and vary the release or admission of fuel into the carburetor of an internal combustion engine.

The preferred embodiment consists primarily of a piston and cylinder that are mated concentrically, and coexist in a carburetor chamber. Their purpose is to directly control the rate of fuel release into the chamber and vary this amount of fuel, through relative movement between the cylinder and piston. The cylinder is connected to the fuel supply and has at least one slot cut in it, in a longitudinal direction, to allow the release of the fuel from the cylinder into the carburetor chamber. Through the relative longitudinal movement of the piston in the cylinder, the exposed length of the slot is varied, thereby varying the amount and rate that the fuel can enter the chamber.

The piston is attached to and may be controlled by a rocker arm. This rocker arm can be manipulated through a series of links back to a user operated control lever or controlling foot pedal. These links can be of varying lengths, designed to give the user the desired lever to piston movement ratio. For example, the piston can be moved approximately half an inch through the movement of the foot pedal by approximately two and a half inches. This rocker arm may move rotationally or linearly.

When the control lever or controlling foot pedal is in the neutral position, the piston is positioned relative to the slot(s) so as to allow the minimum amount of fuel into the carburetor chamber. This position may be set using limiting or controlling means, such as pins and set screws or adjustment bolts, for example, on the rocker arm and is called the idle position. When the piston position is at a point where most or all of the length of the slot(s) are exposed, then the maximum amount of fuel can be released. This is called the maximum torque or maximum speed position. A bolt or pin on the rocker arm can be used to set this maximum. Both the idle position mechanism and maximum torque mechanism can be adjusted by the user, depending on the engine requirements.

An alternative embodiment to vary fuel supply, involves changing the pressure differential between the carburetor chamber and the fuel supply. This utilizes an intermediary reservoir between the fuel supply and carburetor. The fuel supply may be moved relative to the carburetor intake, so as to create a pressure differential between the fuel supply and the carburetor. This movement may be between one and three inches, for example. This movement can be controlled through computer control or lever action by the user. The smaller the pressure differential, the less sensitive the carburetor will be to airflow changes, for example, the rate of change of the air flow will produce less changes in fuel intake than if the pressure differential was greater. With a larger pressure differential, the airflow changes will make significant changes to the fuel intake rate. This would be useful to make a more or less sensitive or responsive engine.

DETAILED DESCRIPTION

Figure 1:
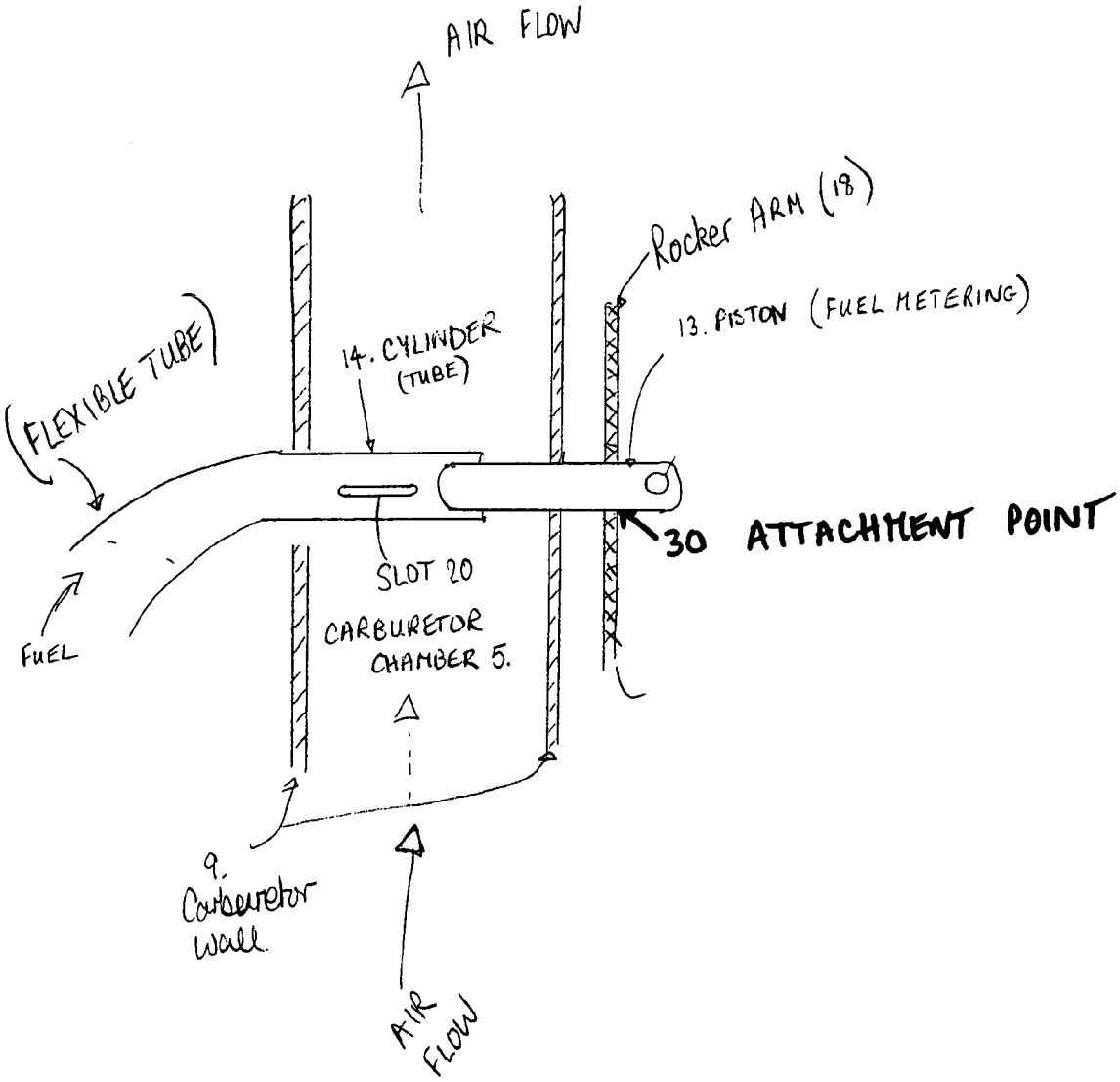
FIG. 1 is a schematic diagram showing detail of the mechanism of the variable fuel admission carburetor of the preferred embodiment of the present invention.
Figure 2:
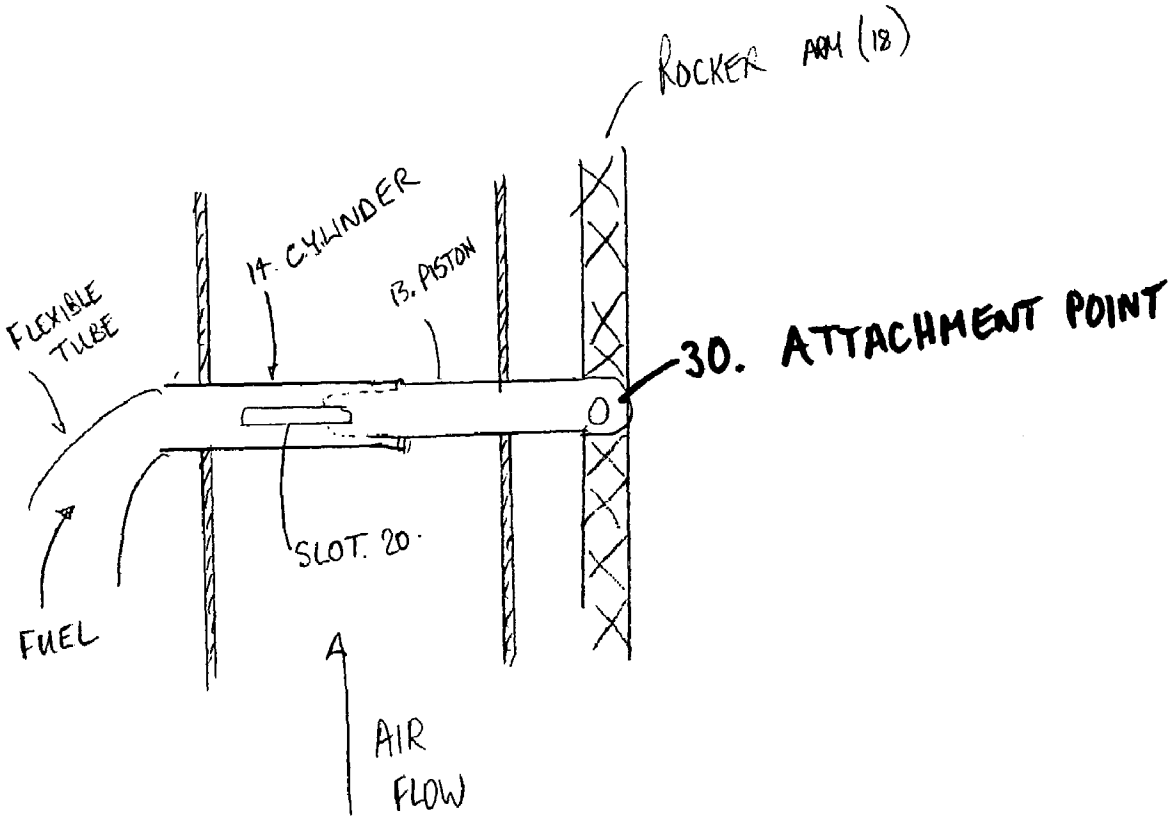
FIG. 2 is a schematic diagram showing detail of the mechanism of the variable fuel admission carburetor of an alternative embodiment of the present invention.

Please refer to FIG. 1. FIGS. 1 and 2 show a variable fuel admission carburetor which essentially consists of a fuel supply cylinder 14 and a fuel metering piston 13 in a carburetor chamber 5. The piston 13 is controlled using a rocker arm 18. The carburetor chamber is in-between the two carburetor walls 9. FIG. 1 shows the rocker arm attached rigidly somewhere along the piston 14. FIG. 2 shows the rocker arm pivotally attached to the piston 14.

Fuel is supplied via the cylinder 14 and is released into the carburetor chamber 5, through at least one slot 20 in the cylinder wall 14. The cylinder 14 may be fixed in position.

Figure 3B:
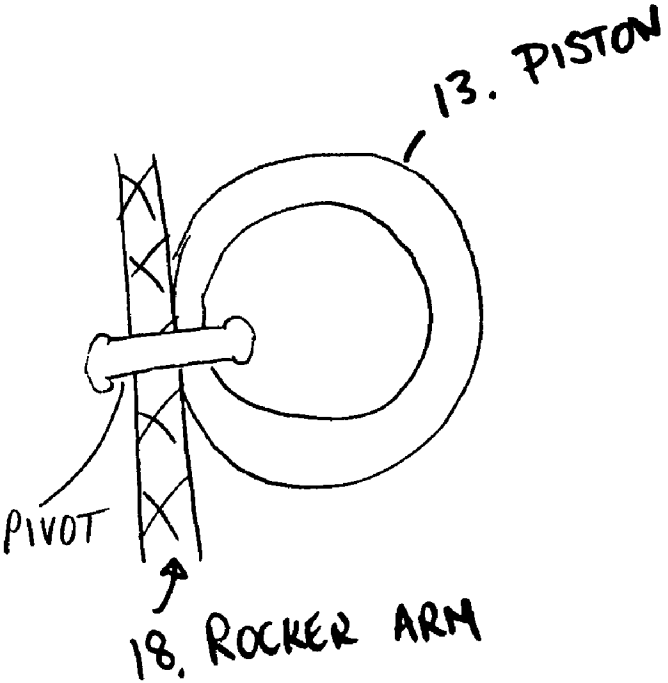
FIG. 3A and FIG. 3B show two embodiments of the attachment between the rocker arm and the piston.
Figure 3A:
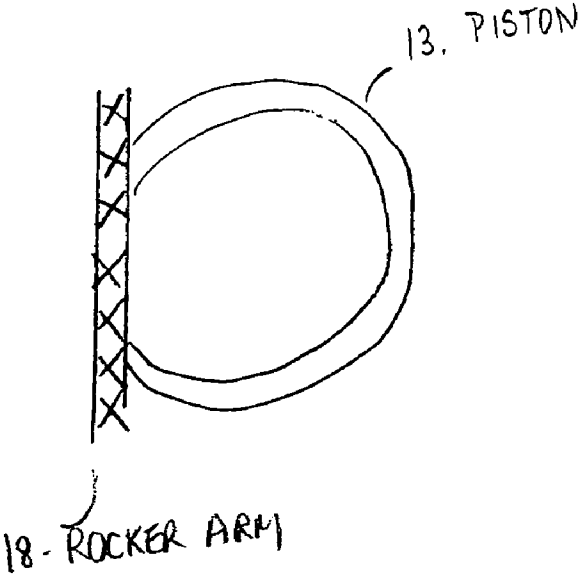

The piston 13 moves along the internal diameter of the cylinder 14, essentially varying the length(s) of the slot(s) 20, which varies the amount of fuel that is released into the carburetor chamber 5. The rocker arm 18 is mechanically attached to the piston 13 at attachment point 30 along the piston 13 outside the carburetor chamber 5, either pivotally (as seen in FIG. 3AB) or rigidly (as seen in FIG. 3A). The rocker arm 18 may move linearly or rotationally.

Figure 4:
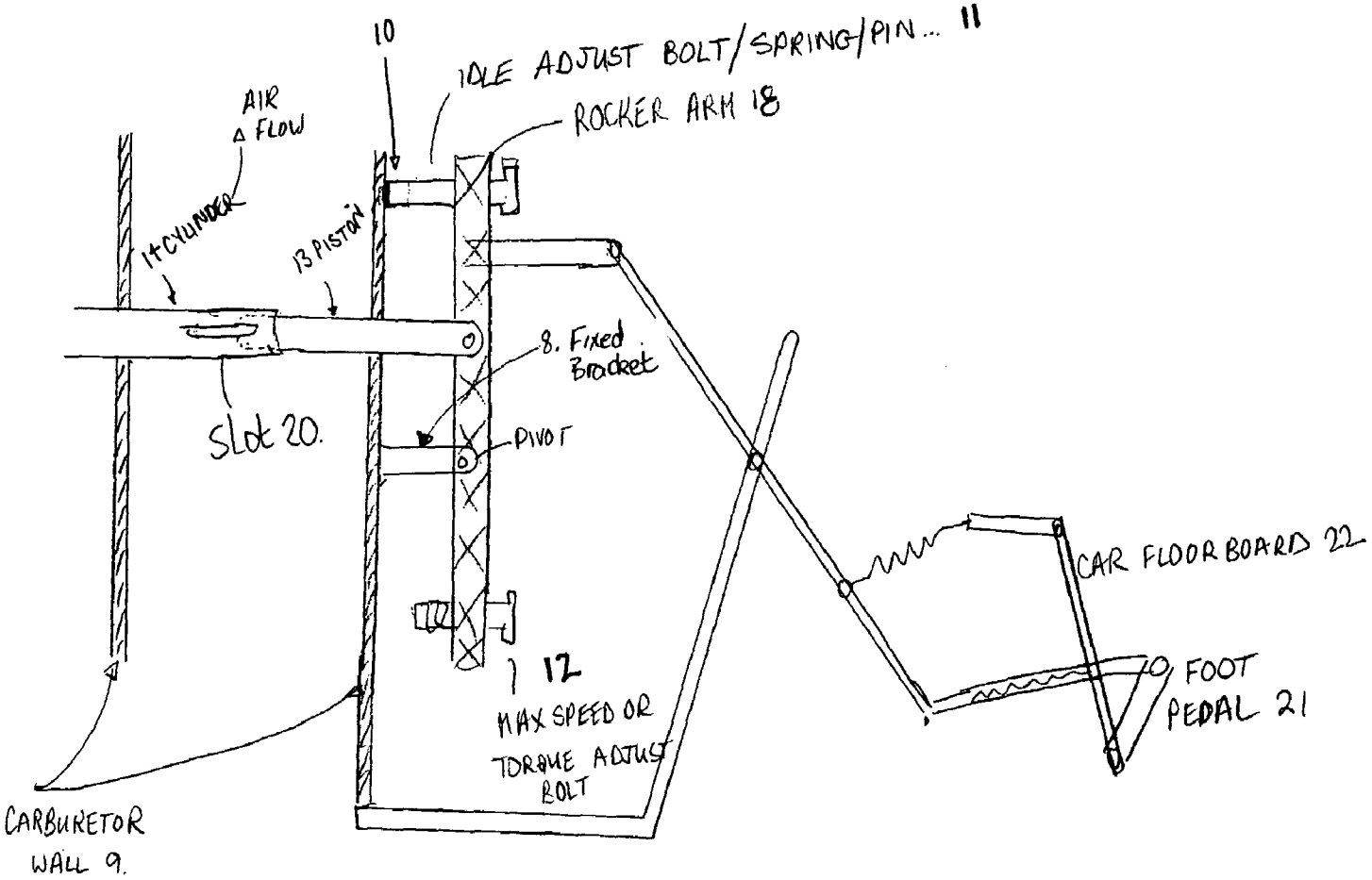
FIG. 4 is a schematic diagram showing the variable fuel admission carburetor of an alternative embodiment of the present invention as it may cooperate with operative linkages in an automobile.

FIG. 4 shows a possible mechanism for actuating the piston 13 mechanism, that could rotate the rocker arm 18 directly, via a foot pedal control. This foot pedal control could also be chain saw or lawn mower lever. FIGS. 4 also shows a mechanism to set the minimum and maximum position for the piston 13.

Through a series of linkages, the depression and release of the foot pedal 21, rotates the rocker arm 18, so as to move the piston 13 relative to the cylinder 14. For example, the foot pedal 21 movement could be approximately two and one half inches, to move the piston 13 one half of an inch.

During pedal depression, this motion of the piston 13 makes the slot(s) 20 longer and therefore admits more fuel. When the foot pedal 21 is not depressed, the piston 13 is in a position where most of the slot(s) is covered. This is called the idle position and is the piston 13 position that allows the engine to idle with the minimum amount of fuel. When the foot pedal 21 is depressed all the way down to the floor board 22, the mechanism pulls the piston back so as to expose the maximum length of the slot(s) 20. This is called the maximum speed or maximum torque position.

The idle position may be set by a mechanism on the rocker arm 18 that stops it from rotating or translating in such a way, as to push the piston 13 to cover more of the slot(s) 20. This can be an adjustment bolt, pin with a set screw 11, for example. When the gap 10 is zero, this is the idle position.

The maximum torque or speed position can be controlled also using an adjustment bolt or pin with a set screw 12, for example. This mechanism will set the maximum length of slot(s) 20 exposed to the air flow. It may also prevent the piston 13 from falling out of the cylinder 14.

Figure 5:
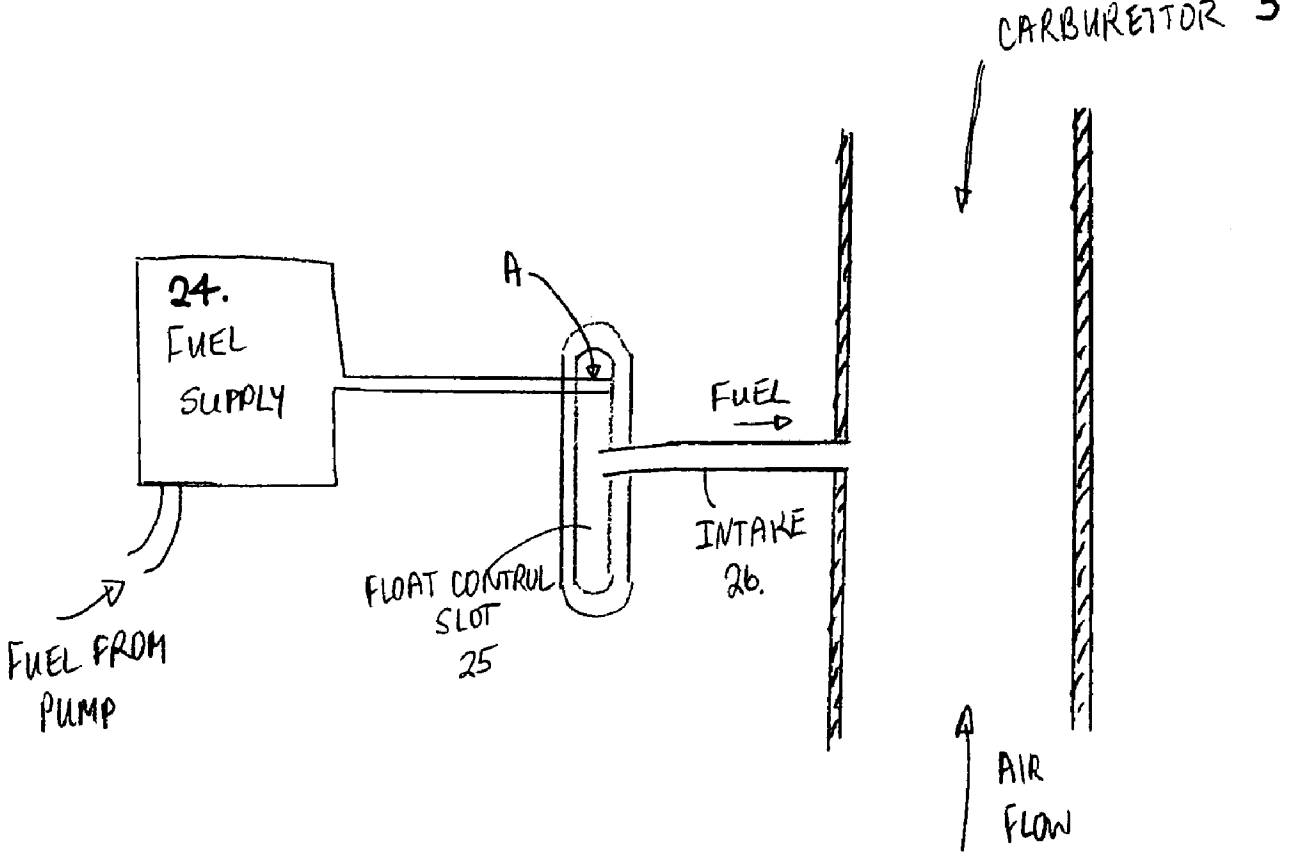
FIG. 5 is a schematic diagram showing a further alternative embodiment of the present invention including a float system.

FIG. 5 shows an alternative method of varying and controlling the fuel supply to the carburetor, using a float and pressure head system. This system involves a float control slot 25 positioned between the fuel supply 24 and the carburetor chamber 5. The position A, on the float control slot 25 and thereby the fuel supply 24, can be physically moved up or down by the user, or controlled by a computer. This creates a pressure head differential in the float control slot 25 between the fuel supply 24 and the intake 26. By moving the point A, the amount or rate of fuel drawn into the carburetor chamber 5 varies. If the position of A is closer to the intake 26, for example one inch, then the pressure differential is small between them, and the fuel released into the carburetor chamber 5 is small and it will be less responsive to airflow changes within the carburetor chamber 5. If the position of A is further away from the fuel intake 26, for example three inches, then the pressure differential will be higher, more fuel will be released into the carburetor chamber 5 and the fuel supply will be more sensitive to air flow changes.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

I claim:

1. A variable fuel admission carburetor comprising:

a carburetor chamber bordered by carburetor walls;

a fuel supply cylinder having a first end, a second end and second end segment, said first end is external to the chamber and is connected to a fuel supply, said second end and second end segment both being inside the chamber;

said cylinder is positioned approximately perpendicular to the carburetor wall;

at least one longitudinal slot in the cylinder second end segment, to allow fuel release into the carburetor chamber;

a fuel metering piston having a first section and a second section, said first section mated concentrically with the cylinder second segment and said second section is outside the carburetor chamber;

means for moving the piston and cylinder relative to each other, so as to vary the length of slot exposure.

2. A variable fuel admission carburetor as in claim 1 wherein said means for moving the piston is a rocker arm located outside of the carburetor chamber, wherein said means is mechanically connected to the piston second section.

3. A variable fuel admission carburetor as in claim 2, wherein said rocker arm moves linearly.

4. A variable fuel admission carburetor as in claim 2, wherein said rocker arm moves rotationally.

5. A variable fuel admission carburetor as in claim 2, wherein said piston is rigidly attached to said rocker arm.

6. A variable fuel admission carburetor as in claim 2 wherein said piston is pivotally attached to said rocker arm.

7. A variable fuel admission carburetor as in claim 1, further comprising a mechanical means for setting a minimum and maximum piston position relative to the slot.

8. A variable fuel admission carburetor as in claim 2, further comprising a mechanical means for setting a minimum and maximum piston position relative to the slot.

9. A variable fuel admission carburetor as in claim 7 wherein said minimum and maximum position is set using a mechanical means on said rocker arm.

10. A variable fuel admission carburetor as in claim 1 wherein said piston is controlled through mechanical linkages to a foot pedal on a car.

11. A variable fuel admission carburetor as in claim 2 wherein said piston is controlled through mechanical linkages to a foot pedal on a car.

12. A variable fuel admission carburetor as in claim 10 wherein said foot pedal moves approximately 2.5 inches to move the piston approximately one half of an inch.

13. A variable fuel admission carburetor as in claim 11 wherein said foot pedal moves approximately 2.5 inches to move the piston approximately one half of an inch.

14. A variable fuel float control comprising:

a fuel supply;

a float control slot having an upper section and a lower section, said fuel supply moveably connected to the upper section of the slot so as to allow the passage of fuel from the fuel supply into the slot;

a fuel intake tube connected to the slot's lower section;

a carburetor chamber, connected to the fuel intake tube, so as to allow the passage of fuel from the slot into the carburetor chamber.

15. A variable fuel float control as in claim 14 wherein the moveably connected fuel supply can move up and down approximately one to three inches.

16. A variable fuel float control as in claim 14 wherein the fuel supply is moved through computer control or levers by the user.

* * * * *